US006148477A

United States Patent [19]

Cheng

[11] Patent Number: 6,148,477

[45] Date of Patent: Nov. 21, 2000

[54] EXPANDABLE PULL ROD OF LUGGAGE

[76] Inventor: Lee Tung Cheng, No. 103-2, Chung Cheng Rd., Wufeng Hsiang, Taiwan

[21] Appl. No.: 09/268,742

[22] Filed: Mar. 13, 1999

[51] Int. Cl.[7] ..... B62B 7/00; A45C 3/00

[52] U.S. Cl. ..... 16/113.1; 280/655

[58] Field of Search ..... 16/113.1, 405, 16/429; 190/115, 18 A; 280/655, 655.1, 47.315, 47.317

[56] References Cited

U.S. PATENT DOCUMENTS

| | | | |
|---|---|---|---|
| 4,256,320 | 3/1981 | Hager | 190/18 A |
| 5,308,103 | 5/1994 | Chin-shung | 280/655 |
| 5,636,410 | 6/1997 | Chou | 16/113.1 |
| 5,694,663 | 12/1997 | Tserng | 16/113.1 |
| 5,704,725 | 1/1998 | Horing | 16/113.1 |
| 5,893,196 | 4/1999 | Tserng | 16/113.1 |
| 5,956,807 | 9/1999 | Kuo | 16/113.1 |
| 6,026,543 | 2/2000 | Chen | 16/113.1 |

*Primary Examiner*—Chuck Y. Mah
*Attorney, Agent, or Firm*—W. Wayne Liauh

[57] ABSTRACT

An expandable pull rod of a luggage is formed of a handle, an adjustment device disposed in the handle, an inner tube fastened with the bottom end of the handle, a first locating element fastened with the inner tube, a first outer tube sleeved over the inner tube such that the first outer tube and the inner tube and securely connected by the first locating element, a second locating element fastened with the bottom end of the first outer tube, and a second outer tube sleeved over the first outer tube such that the first outer tube and the second outer tube are connected by the second locating element. The expansion and the retraction of the expandable pull rod are achieved by the first locating element and the second locating element. By activating the adjustment device, the inner tube and the first outer tube can be fully retracted into the second outer tube.

3 Claims, 10 Drawing Sheets

EXPANDABLE PULL ROD OF LUGGAGE

FIELD OF THE INVENTION

The present invention relates generally to a luggage, and more particularly to an expandable pull rod of the luggage.

BACKGROUND OF THE INVENTION

As shown in FIG. 1, a conventional expandable pull rod of the luggage and the like is composed of an inner tube and an outer tube fitted over the inner tube which can be extracted and retracted to facilitate the moving of the luggage on a surface. The outer tube of the conventional expandable pull rod has a predetermined length. As a result, the overall volume of the luggage can not be significantly reduced.

SUMMARY OF THE INVENTION

It is therefore the primary objective of the present invention to provide a luggage with an expandable pull rod comprising an inner tube, a first outer tube, a second outer tube, a first locating element, and a second locating element. The inner tube is slidably received in the first outer tube such that the inner tube can be extracted from or retracted into the first outer tube. As the inner tube is retracted into the first outer tube, the second locating element is urged by the first locating element such that the second outer tube is released by the second locating element so as to enable the first outer tube to be retracted into the second outer tube.

The foregoing objective, features, functions, and advantages of the present invention will be more readily understood upon a thoughtful deliberation of the following detailed description of the preferred embodiments of the present invention with reference to the accompanying drawings.

DETAILED DESCRIPTION OF THE EMBODIMENTS

Figure 1:
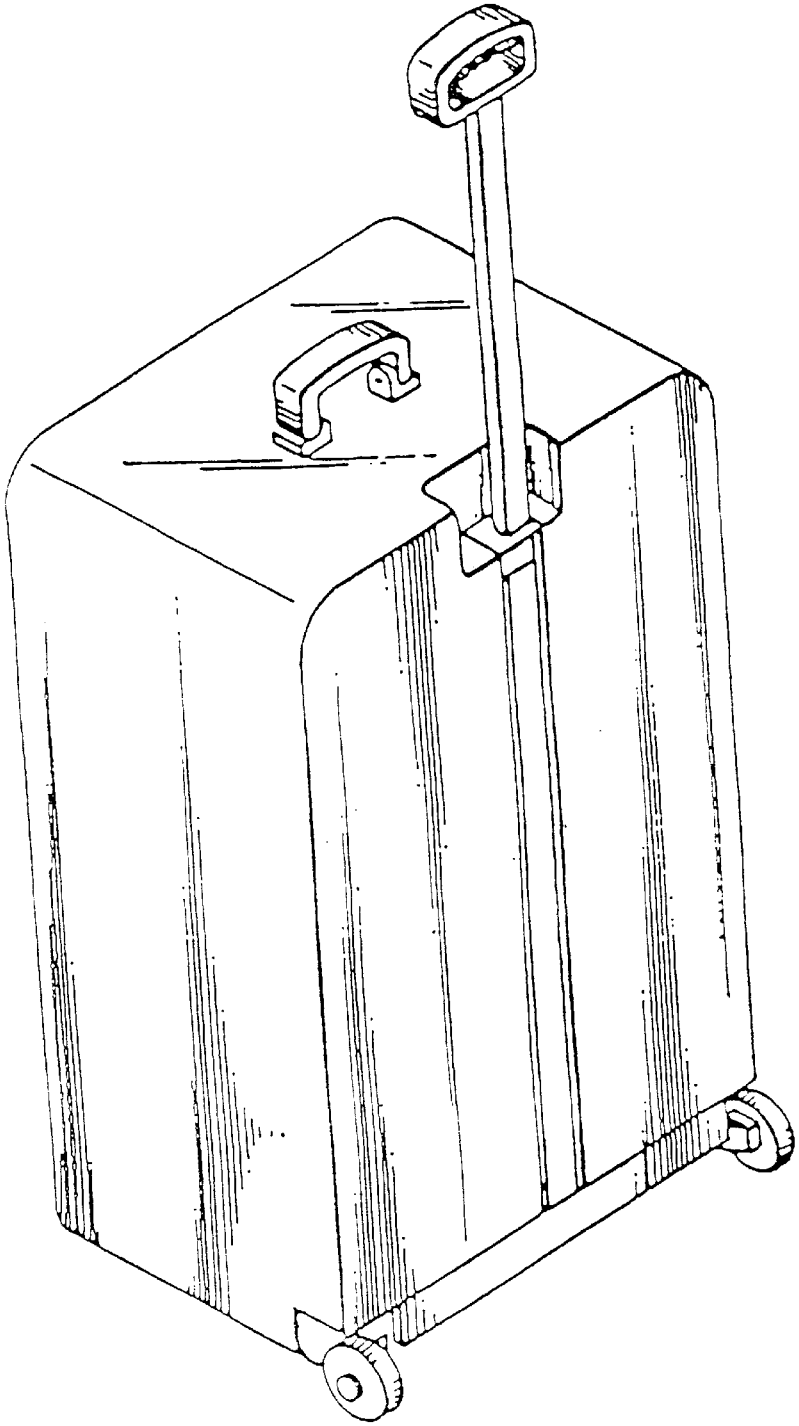
FIG. 1 (PRIOR ART)
FIG. 1 shows a perspective view of the prior art.
Figure 2:
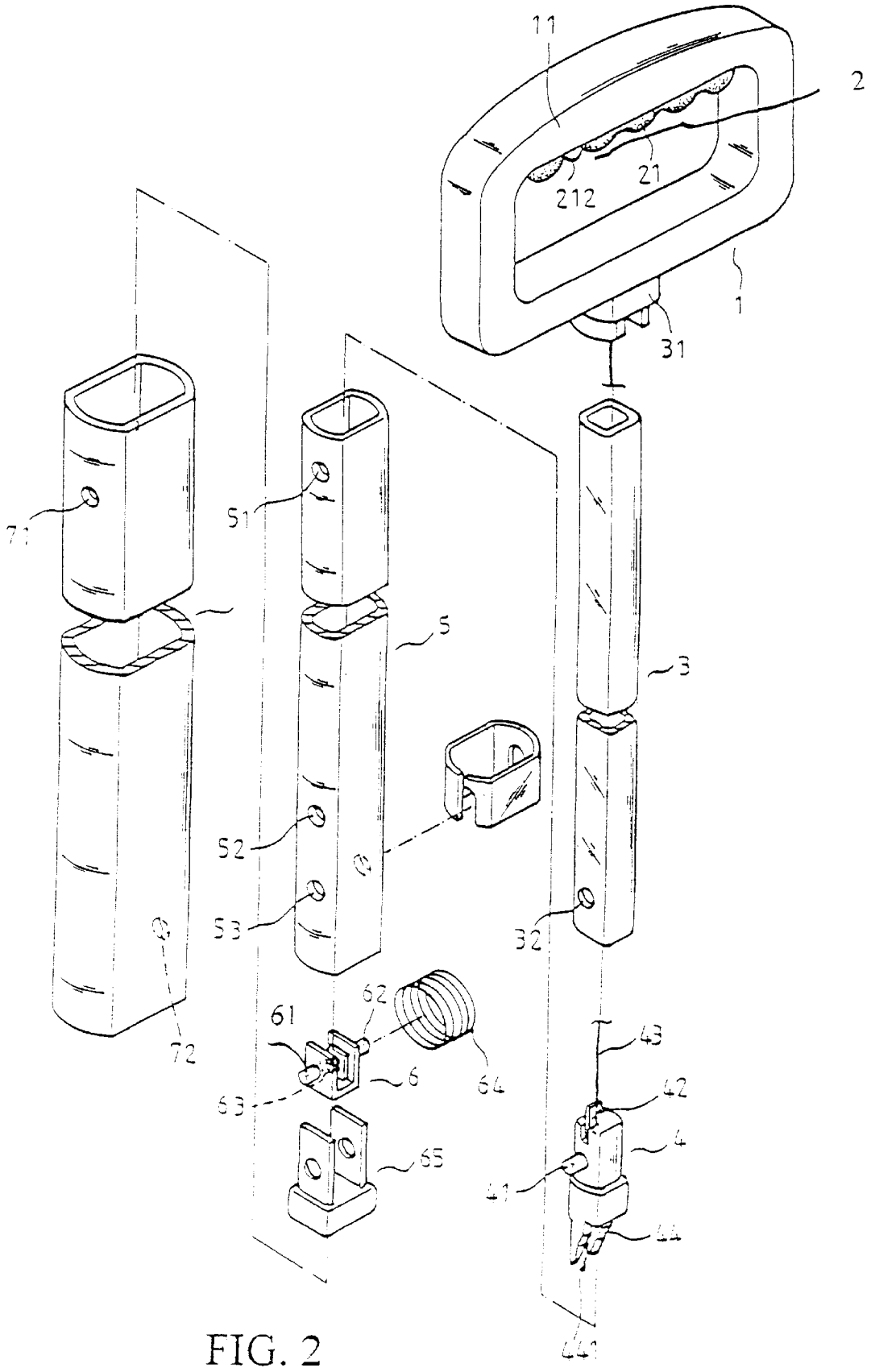
FIG. 2 shows an exploded view of the present invention.
Figure 3:
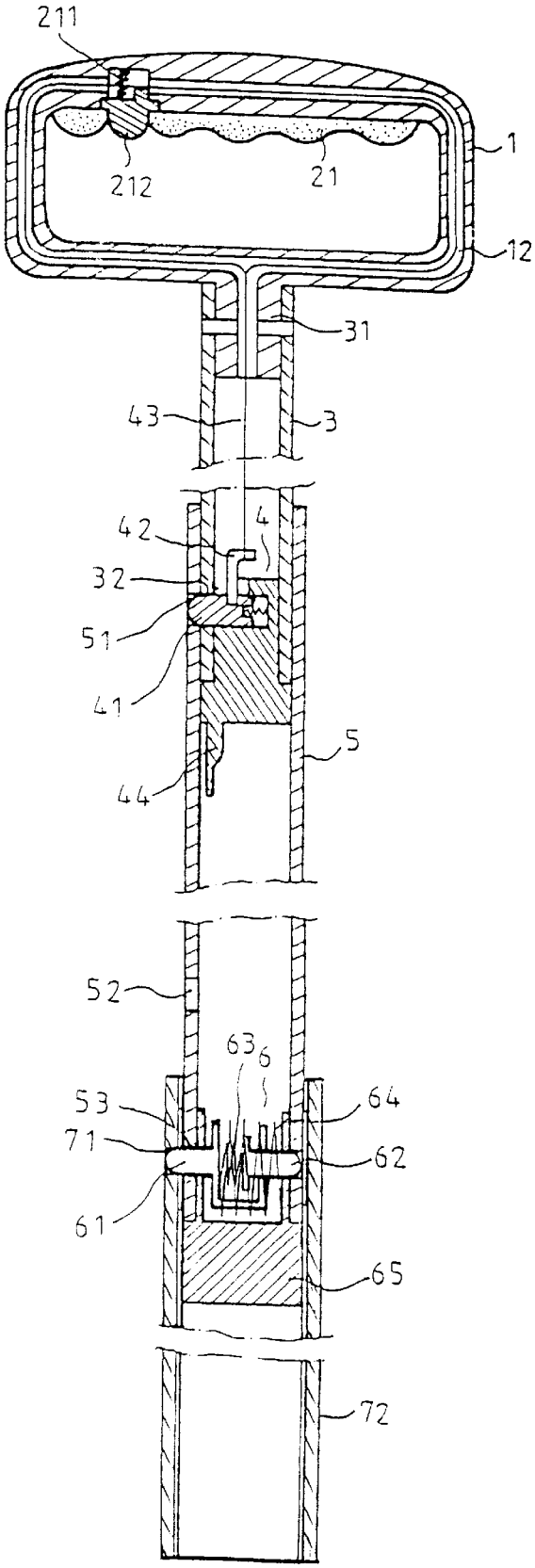
FIG. 3 shows a sectional view of the present invention in combination.

As shown in FIGS. 2 and 3, an expandable pull rod embodied in the present invention is used in conjunction with a luggage, and the like and is composed of a handle 1, an adjustment device 2, an inner tube 3, a first locating element 4, a first outer tube 5, a second locating element 6, and a second outer tube 7.

The handle 1 is provided with a grip 11, and a cord channel 12 located inside the handle 1.

The adjustment device 2 has a grip portion 21 which is jutted out of the bottom of the grip 11 of the handle 1 and is provided with a press portion 212 having a spring 211. The press portion 212 is disposed in the cord channel 12 of the handle 1.

The inner tube 3 is provided with a fastening body 31 fastened therewith. The fastening body 31 is fastened with the bottom end of the handle 1. The inner tube 3 is further provided with a through hole 32.

The first locating element 4 is fastened with the bottom end of the inner tube 3 and is provided with a first locating portion 41 corresponding in location to the through hole 32 of the inner tube 3. The first locating portion 41 is joined with an L-shaped body 42 of the first locating element 4. The L-shaped body 42 is in turn joined with a pull cord 43 which is disposed in the cord channel 12 of the handle 1 and the inner tube 3.

FIG. 2 shows all the components of the expandable pull rod of the present invention, and FIG. 3 shows the pull rod of the present invention when it is fully extended. As the pull cord 43 is pulled, the L-shaped body 42 is atuated to trigger the first locating portion 41 to extract or retract. The first locating element 4 is provided with a retaining portion 44 of an inclined and arcuate construction and having a clamp hole 441.

The first outer tube 5 is fitted over the inner tube 3 and is provided with a first through hole 51 located in the same side of the through hole 32 of the inner tube 3, a second through hole 52 located in the same side of the first through hole 51 of the first outer tube 5, and a locating hole 53.

The second locating element 6 is provided with a second locating portion 61, a third locating portion 62, and a spring 63 located between the second locating portion 61 and the third locating portion 62. The second locating element 6 is fitted into a buffer spring 64. The second locating element 6 is disposed in a fastening seat 65 such that the second locating element 6 is fastened with the first outer tube 5.

The second outer tube 7 is fitted over the first outer tube 5 and is provided with a locating hole 71 located in the same side of the second locating portion 61 of the second locating element 6, and a fastening hole 72 located in the same side of the third locating portion 62 of the second locating element 6.

In combination, the fastening body 31 of the inner tube 3 is fastened with the bottom end of the handle 1. The first locating element 4 is disposed in the inner tube 3 such that the first locating portion 41 of the first locating element 4 is jutted out of the through hole 32 of the inner tube 3, and that the first locating portion 41 of the first locating element 4 is retained in the first through hole 51 of the first outer tube 5 which is fitted over the inner tube 3. As a result, the inner tube 3 is secured with the first outer tube 5. The first outer tube 5 is fastened at the bottom end thereof with the fastening seat 65 of the second locating element 6 such that the second locating portion 61 of the second locating element 6 is jutted out of the locating hole 53 of the first outer tube 5. In light of the second outer tube 7 being fitted over the first outer tube 5, the second locating portion 61 is retained in the locating hole 71 of the second outer tube 7. The first outer tube 5 and the second outer tube 7 are thus joined together securely.

Figure 4:
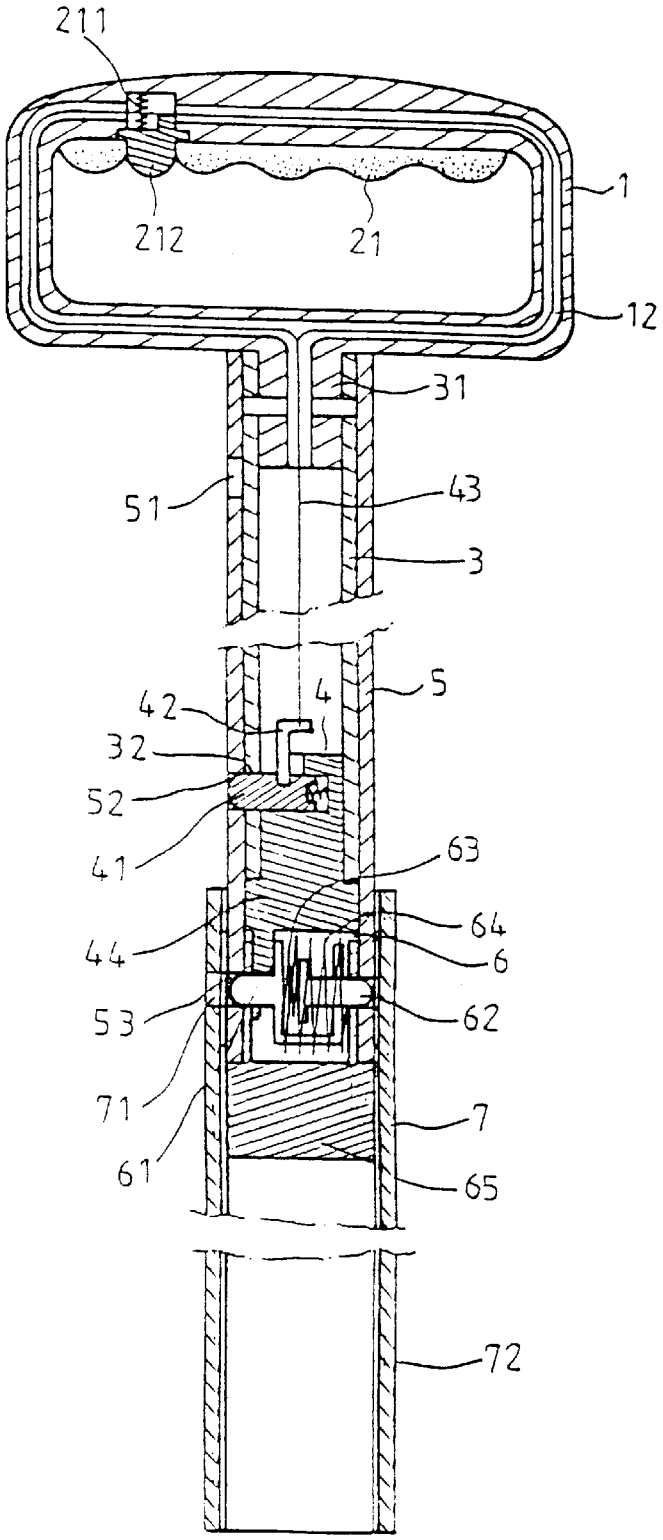
FIG. 4 show a schematic view of the present invention at work.
Figure 5:
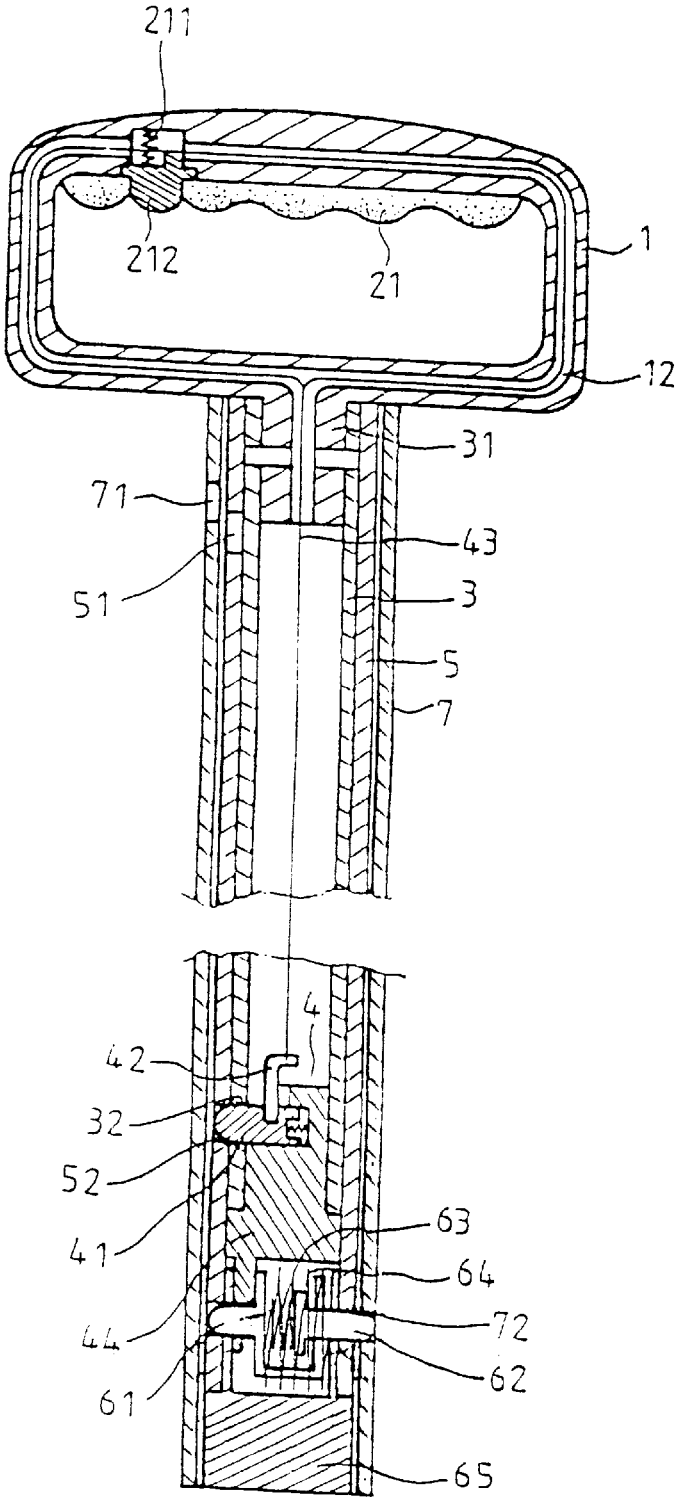
FIG. 5 shows another schematic view of the present invention at work.

FIG. 4 shows the expandable pull rod of the present invention when it is half-way retracted, i.e., only the inner tube 3 is received into the first outer tube 5. FIG. 5 shows the expandable pull rod of the present invention when it is fully retracted, i.e., the first outer tube 5 is further received into the second outer tube 7.

As shown in FIG. 4, the expandable pull rod of the present invention is retracted by first pressing the press portion 212 of the grip 11 of the handle 1, so as to activate the pull cord 43 to actuate the L-shaped body 42, thereby resulting in the withdrawal of the first locating portion 41. As a result, the first outer tube 5 is relieved of the retaining force of the first locating portion 41. The inner tube 3 is therefore retracted into the first outer tube 5 by virtue of its own weight such that the first locating portion 41 of the first locating element 4 is retained in the second through hole 52 of the first outer tube 5. The inner tube 3 is thus securely located in the first outer tube 5 such that the clamp hole 441 of the retaining portion 44 of the first locating element 4 retains securely the second locating portion 61 of the second locating element 6. In light of the bottom of the retaining portion 44 being of an inclined and arcuate construction, the second locating portion 61 is so pressed by the retaining portion 44 that the buffer spring 64 and the spring 63 are compressed to bring about the disengagement of the second locating portion 61 with the second outer tube 7. The first outer tube 5 is thus retracted into the second outer tube 7 by virtue of its own weight. Now referring to FIG. 5, the spring 63 located between the second locating portion 61 and the third locating portion 62 of the second locating element 6 is compressed. For this reason, when the first outer tube 5 is retracted into the second outer tube 7, the third locating portion 62 of the second locating element 6 is forced out by the elastic force of the compressed spring 63 such that the third locating portion 62 is retained in the fastening hole 72 of the second outer tube 7. As a result, the first outer tube 5 is securely located in the second outer tube 7. In reverse, the first outer tube 5 can be extracted from the second outer tube 7 such that the first outer tube 5 is located to give an added length to the expandable pull rod of the present invention.

Figure 6:
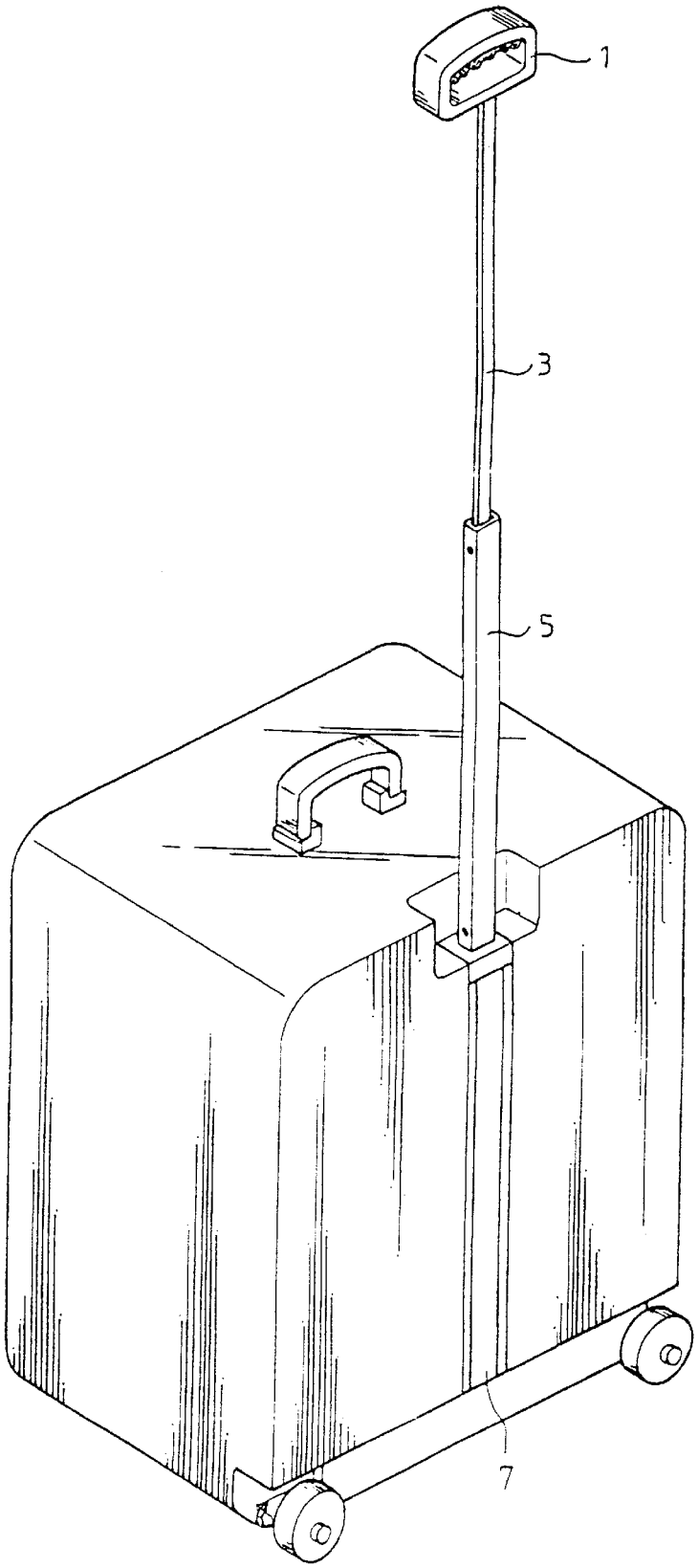
FIG. 6 shows a schematic view of extraction of the expandable pull rod of the present invention.
Figure 7:
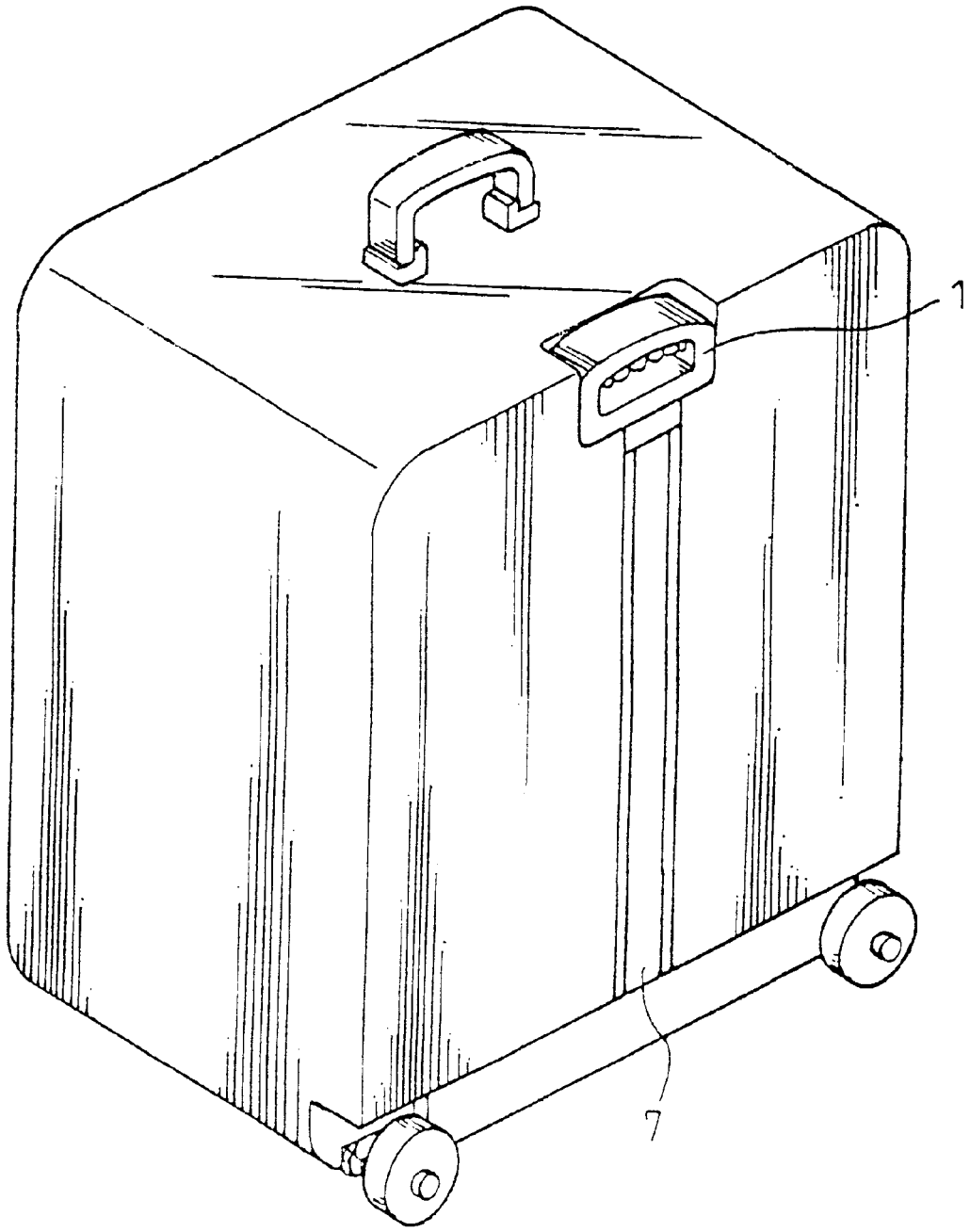
FIG. 7 shows a schematic view of retraction of the expandable pull rod of the present invention.

As shown in FIGS. 6 and 7, the overall length of the expandable pull rod of the present invention is formed of the inner tube 3, the first outer tube 5 and the second outer tube 7. When the expandable pull rod of the present invention is fully retracted, the overall length of the expandable pull rod of the present invention is equal to the length of the second outer tube 7 in view of the fact that the inner tube 3 is fully retracted into the first outer tube 5 and that the first outer tube 5 is then fully retracted into the second outer tube 7.

Figure 8:
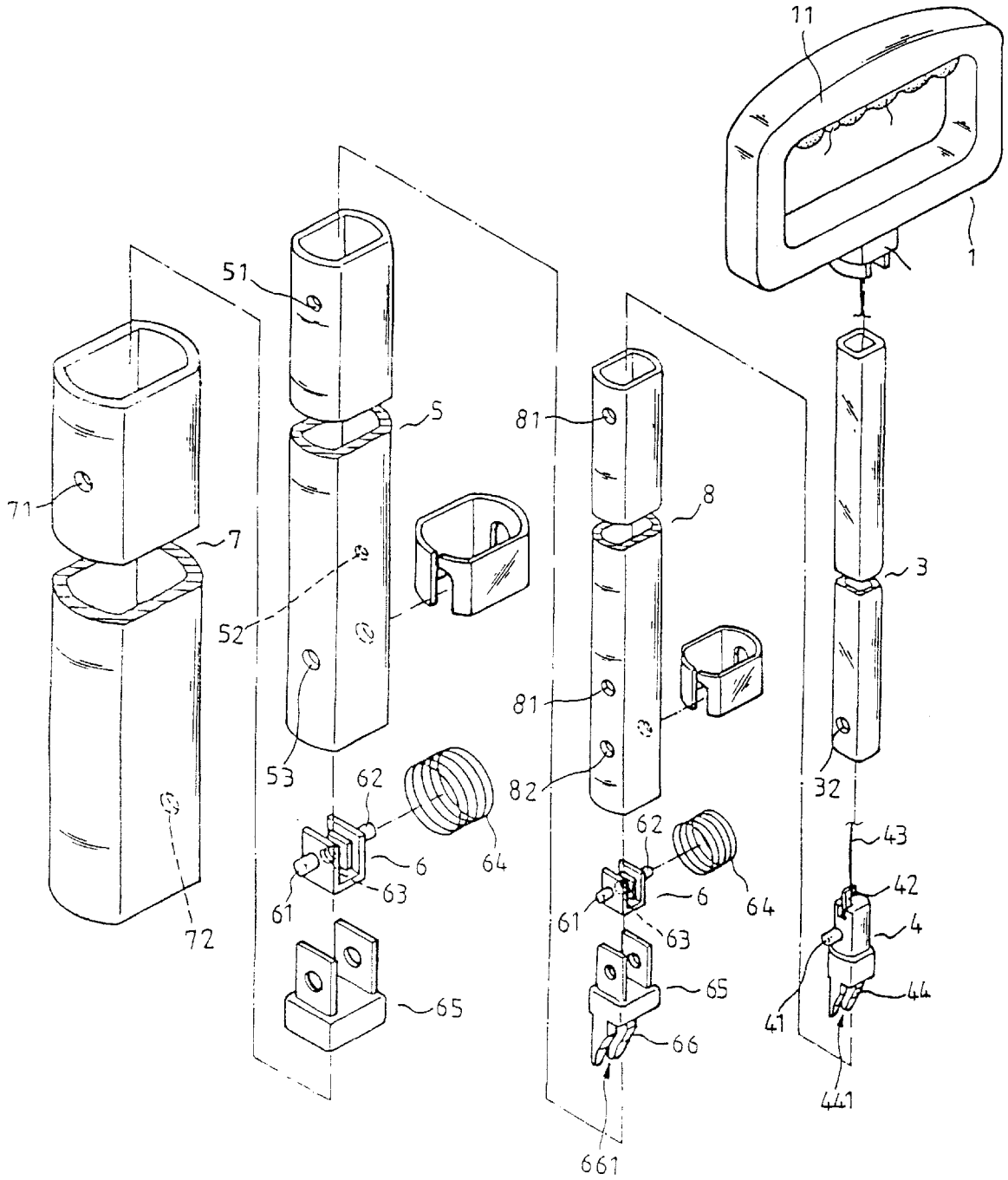
FIG. 8 shows an exploded view of a second preferred embodiment of the present invention.
Figure 9:
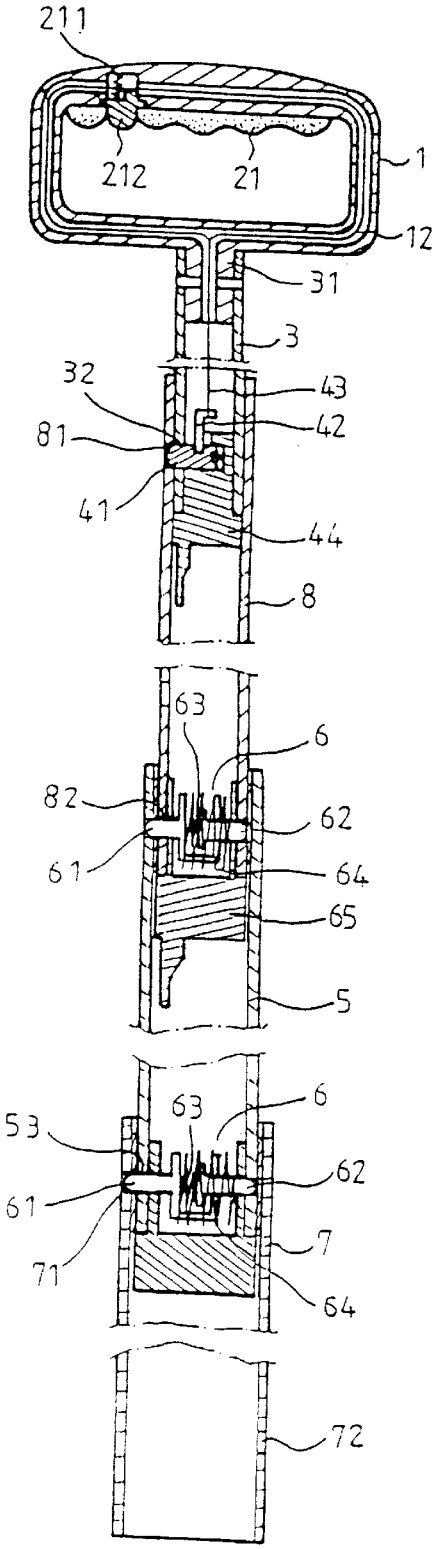
FIG. 9 shows a schematic view of the second preferred embodiment of the present invention at work.
Figure 10:
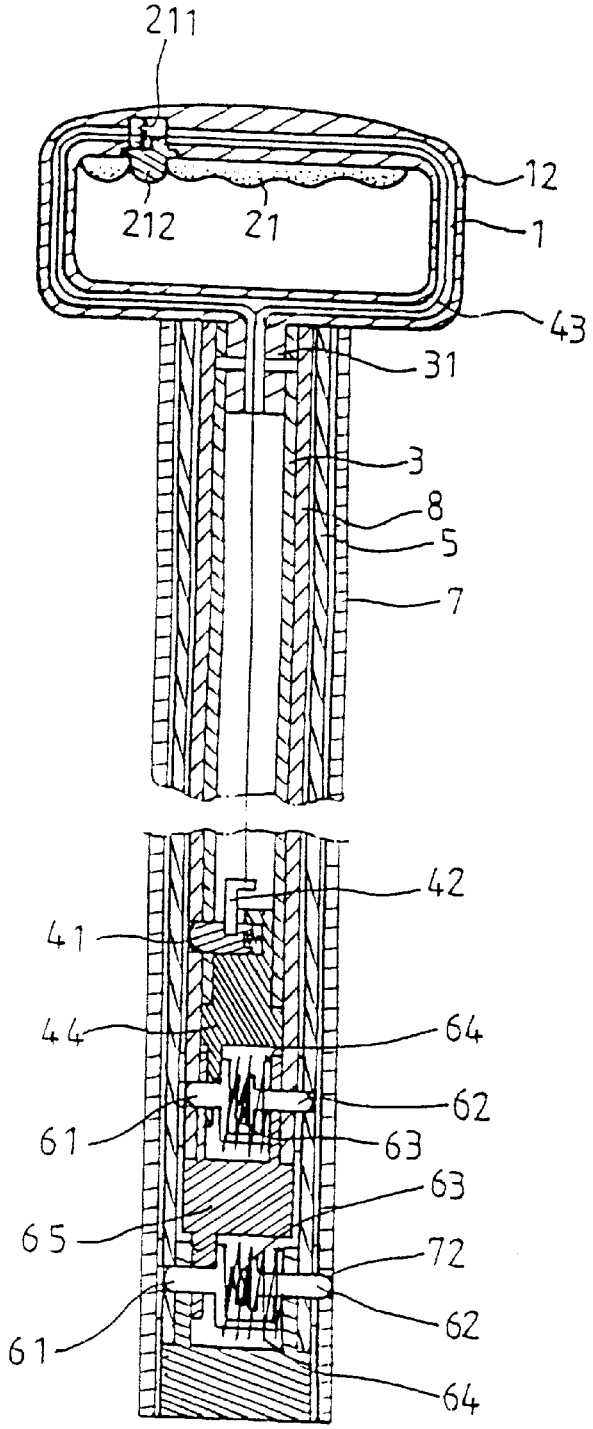
FIG. 10 shows another schematic view of the second preferred embodiment of the present invention at work.

As shown in FIG. 8, the expandable pull rod of the present invention further comprises a plurality of third outer tubes 8 disposed between the inner tube 3 and the first outer tube 5 such that the third outer tubes 8 are fastened at the bottom end thereof with the fastening seat 65 of the second locating element 6. The fastening seat 65 is provided at the bottom thereof with a retaining portion 66 which is in turn provided with a clamp hole 661. The third outer tubes 8 are provided with a through hole 81 and a locating hole 82, which are located in the same side of the locating hole 71 of the second outer tube 7. Now referring to FIG. 9, the inner tube 5 and the third outer tube 8 are retained by the first locating portion 41 of the first locating element 4 which is fastened with the bottom end of the inner tube 3. In the meantime, the third outer tube 8 and the first outer tube 5 are retained by the second locating portion 61 of the second locating element 6. As shown in FIG. 10, the expandable pull rod of the present invention is retracted by activating the L-shaped body 42 of the inner tube 3 so as to actuate the first locating portion 41 to disengage the third outer tube 8, thereby enabling the inner tube 3 to be retracted into the third outer tube 8. In the meantime, the second locating portion 61 which is located in the third outer tube 8 is pressed by the retaining portion 44 so as to cause the second locating portion 61 to disengage the first outer tube 5, thereby enabling the third outer tube 8 to be retracted into the first outer tube 5.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An expandable pull rod for use in a luggage, comprising:

a handle provided with a grip;

an adjustment device disposed in a bottom of said grip of said handle, said adjustment device comprising a press portion connected to a pull cord;

an inner tube fastened with a bottom end of said handle and provided in one side thereof with a through hole;

a first locating element fastened with a bottom end of said inner tube and provided with a first locating portion corresponding in location to said through hole of said inner tube, said first locating element further provided with an L-shaped body which is fastened with said first locating portion at one end thereof and is connected with said pull cord at another end such that when said pull cord is pulled, said L-shaped is actuated to trigger said first locating portion to retract, said first locating element further provided in a bottom thereof with a retaining portion having a bottom of an arcuate construction and a clamp hole;

a first outer tube fitted over said inner tube and provided at a top end thereof with a first through hole, and at a bottom end thereof with a second through hole and a locating hole;

a second locating element fastened with the bottom end of said first outer tube and provided with a second locating portion, a third locating portion, and a spring located between said second locating portion and said third locating portion to urge said second and third locating portions away from each other, said second locating portion being jutted out of said locating hole of said first outer tube; and a second outer tube fitted over said first outer tube and provided at a top end thereof with a locating hole and at a bottom end thereof with a fastening hole;

wherein when said expandable pull rod is fully extended, said first locating portion of said first locating element is jutted out through said through hole of said inner tube and is retained in said first through hole of said first outer tube so that said inner tube and said first out tube are joined together, and said second locating portion of said second locating element is jutted out through said locating hole of said first outer tube and retained in said locating hole of said second outer tube so that said first outer tube and second outer tube are joined together; and when said press portion of said adjustment device is pressed, said pull cord is caused to actuate said L-shaped body causing said first locating portion to be withdrawn from said first through hole of said first outer tube and allowing said first locating portion to be engaged with said second through hole of said first outer tube when said pull rod is pushed downward;

when said pull rod is pushed further downward, said arcuate bottom and said clamp hole cooperatively compress said spring of said second locating element to allow said second locating portion to be disengaged from said second outer tube, and finally said third locating portion of said second locating element is engaged with said fastening hole of said second outer tube to cause said expandable pull rod to be fully retracted.

2. The expandable pull rod as defined in claim 1, wherein said second locating element is mounted in a fastening seat.

3. The expandable pull rod as defined in claim 1, which further comprises a buffer spring enclosing said second locating element.

* * * * *